United States Patent [19]

Wilson

[11] 3,963,190

[45] June 15, 1976

[54] TISSUE DISPENSING DEVICE FOR A ROLL OF TISSUE

[75] Inventor: Devon S. Wilson, Phoenix, Ariz.

[73] Assignee: The Raymond Lee Organization, Inc., New York, N.Y. ; a part interest

[22] Filed: Feb. 19, 1974

[21] Appl. No.: 443,358

[52] U.S. Cl. ..... 242/55.53; 40/85; 242/107.7

[51] Int. Cl.[2] ..... B65H 19/00

[58] Field of Search ..... 242/55.53, 55.2, 67.1 R, 242/107.4, 67.1 D, 107.6, 107.7; 40/82–85

[56] References Cited

UNITED STATES PATENTS 807,965 12/1905 Rice ..... 40/85

3,317,150 5/1967 Summersby ..... 242/55.2

FOREIGN PATENTS OR APPLICATIONS 161,012 4/1921 United Kingdom ..... 242/55.53

*Primary Examiner*—Leonard D. Christian
*Attorney, Agent, or Firm*—Daniel Jay Tick

[57] ABSTRACT

A tissue dispensing device for a roll of tissue comprises a housing having a slot formed therethrough. A tissue-supporting spool is rotatably mounted in the housing and supports a roll of tissue thereon for rotation therewith. A spool rotating device is affixed to the spool and extends out of the housing for rotating the spool to pass tissue through the slot of the housing.

2 Claims, 4 Drawing Figures

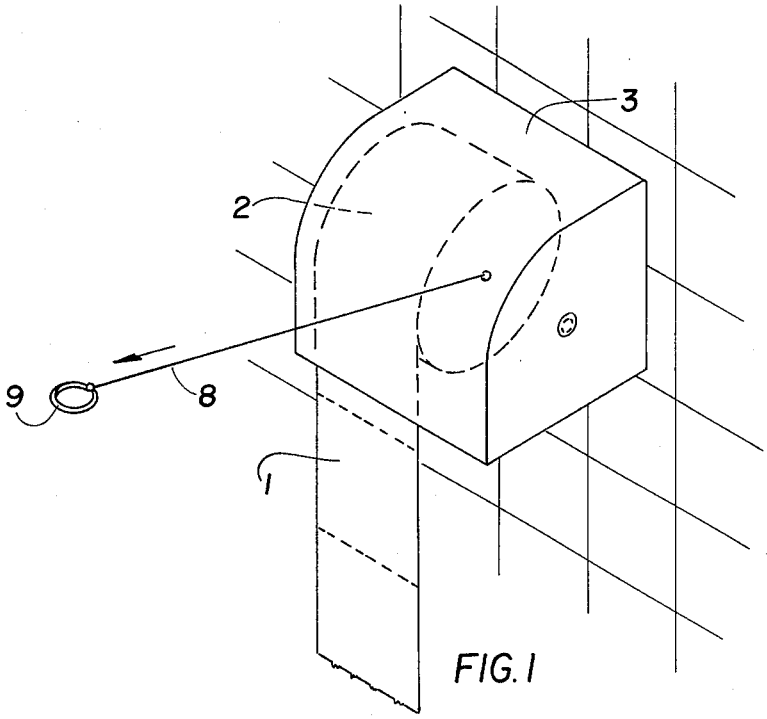
FIG. 1
FIG. 3
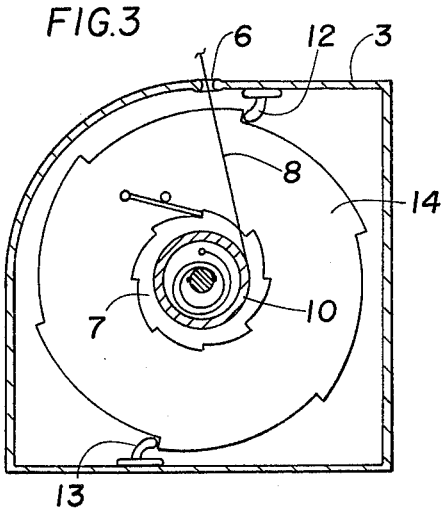
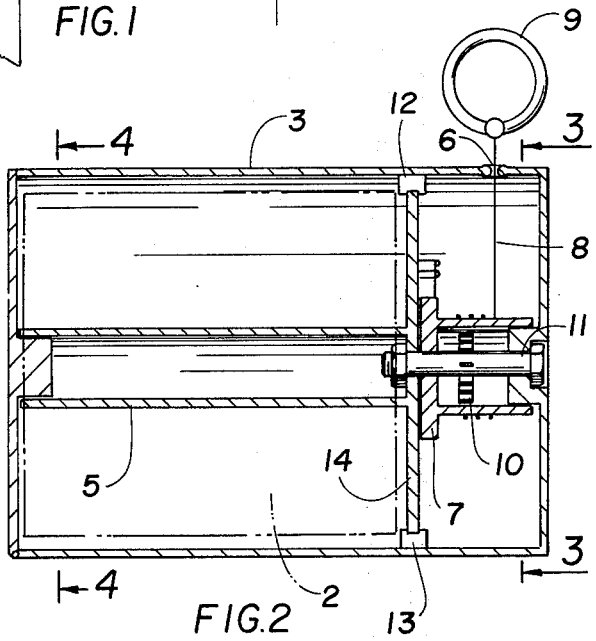
FIG. 2
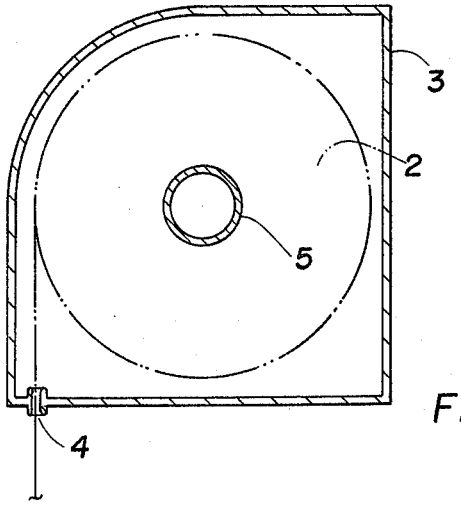
FIG. 4

TISSUE DISPENSING DEVICE FOR A ROLL OF TISSUE

DESCRIPTION OF THE INVENTION

The present invention relates to a tissue dispensing device for a roll of tissue.

The principal object of the invention is to provide a tissue dispensing device for a roll of tissue, paper towels, wax paper, aluminum foil, or the like, which device is of simple structure, is used with simplicity, facility, ease, convenience and comfort, and provides a desired amount of tissue in a sanitary fashion.

In order that the invention may be readily carried into effect, it will now be described with reference to the accompanying drawing, wherein:

FIG. 1 is a schematic diagram of an embodiment of the tissue dispensing device of the invention for a roll of tissue;

FIG. 2 is a longitudinal sectional view of the device of FIG. 1;

FIG. 3 is an axial view, partly in section, taken along the lines 3—3, of FIG. 2; and FIG. 4 is an axial sectional view, taken along the lines 4—4 of FIG. 2.

In the FIGS., the same components are identified by the same reference numerals.

The tissue dispensing device of the invention dispenses tissue 1 of a desired amount (FIG. 1) from a roll of tissue 2 (FIGS. 1, 2 and 4).

The tissue dispensing device of the invention comprises a housing 3 (FIGS. 1 to 4) having a slot 4 (FIG. 4) formed therethrough. A tissue-supporting spool 5 (FIGS. 2 and 4) is rotatably mounted in the housing 3 and supports the roll 2 of tissue thereon for rotation therewith.

A spool rotating device is affixed to the spool 5 and extends out of the housing 3 for rotating the spool to pass tissue 1 through the slot 4 of the housing. The spool rotating device comprises a first ratchet 14 of predetermined diameter (FIGS. 2 and 3) coaxially affixed to the spool 5. A first pawl 13 is affixed to the housing 3 for permitting rotation of the first ratchet 14 in one direction only. Such direction is counterclockwise in the views of FIGS. 2 and 3. A second ratchet 7 has a smaller diameter than the predetermined diameter and is mounted substantially coaxially with the spool 5 independently from said spool in adjacent relation with the first ratchet. A second pawl 15 is affixed to the first ratchet 14 in operative engagement with the second ratchet 7 (FIGS. 2 and 3).

A spring 10 is affixed to the housing 3 and to the second ratchet 7 (FIGS. 2 and 3). The spring 10 preferably comprises a leaf type spiral spring having one end affixed to the second ratchet. A cord 8 (FIGS. 1, 2 and 3) is affixed at one end to the second ratchet 7 and is wound on said second ratchet and extends out of the housing 3 via the aperture 6. A ring 9 (FIGS. 1 and 2) may be affixed at the other end of the cord 8 to facilitate pulling said cord.

When the user wants a desired amount of tissue 1, he pulls the cord 8. When the user pulls the cord 8, he rotates the second ratchet 7 free from interference by the second pawl 15 and winds the spring 10. When the spring 10 is wound, the second pawl 15 catches the second ratchet 7 and said spring unwinds, thereby rotating the spool in a counterclockwise direction via said second pawl and the first ratchet 14. The desired amount of tissue is provided from the roll 2 via the slot 4.

As shown in FIG. 2, a hinged door 16 is provided at one end of the housing 3 in order to replace a roll of tissue therein.

While the invention has been described in a specific example and in a specific embodiment, I do not wish to be limited thereto, for obvious modifications will occur to those skilled in the art without departing from the spirit and scope of the invention.

I claim:

1. A tissue dispensing device for a roll of tissue, said tissue dispensing device comprising a housing having a slot formed therethrough;

a tissue-supporting spool rotatably mounted in the housing and supporting a roll of tissue therein for rotation therewith; and spool rotating means affixed to the spool and extending out of the housing for rotating the spool to pass tissue through the slot of the housing, the spool rotating means comprising a first ratchet of predetermined diameter coaxially affixed to the spool and a first pawl affixed to the housing for permitting rotation of the first ratchet in one direction only, a second ratchet having a smaller diameter than the predetermined diameter mounted substantially coaxially with the spool independently therefrom in adjacent relation with the first ratchet, a second pawl affixed to the first ratchet in operative engagement with the second ratchet, spring means affixed to the housing and to the second ratchet, and a cord affixed at one end to the second ratchet and wound thereon and extending out of the housing whereby pulling of the cord rotates the second ratchet free from interference by the second pawl and winds the spring means and when the spring means is wound the second pawl catches the second ratchet and the spring unwinds thereby rotating the spool via the second pawl and the first ratchet.

2. A tissue dispensing device as claimed in claim 1, wherein the spring means comprises a spiral spring having one end affixed to the housing and another opposite end affixed to the second ratchet.

* * * * *